US006845924B2

(12) United States Patent
Schmon

(10) Patent No.: US 6,845,924 B2
(45) Date of Patent: Jan. 25, 2005

(54) SPRAY PISTOL

(75) Inventor: Ewald Schmon, Grafenberg (DE)

(73) Assignee: Sata-Farbspritztechnik GmbH & Co. KG, Kornwestheim (DE)

( * ) Notice: Subject to any disclaimer, the term of this patent is extended or adjusted under 35 U.S.C. 154(b) by 0 days.

(21) Appl. No.: 10/258,653

(22) PCT Filed: Jun. 27, 2001

(86) PCT No.: PCT/EP01/07323

§ 371 (c)(1),
(2), (4) Date: Mar. 24, 2003

(87) PCT Pub. No.: WO02/00355

PCT Pub. Date: Jan. 3, 2002

(65) Prior Publication Data

US 2003/0164408 A1 Sep. 4, 2003

(30) Foreign Application Priority Data

Jun. 30, 2000 (DE) ..... 100 31 858

(51) Int. Cl.[7] ..... B05B 9/01
(52) U.S. Cl. ..... 239/526
(58) Field of Search ..... 239/71, 72, 290, 239/296, 525–528, 415, DIG. 14

(56) References Cited

U.S. PATENT DOCUMENTS

| | | | | | |
|---|---|---|---|---|---|
| 2,886,252 | A | * | 5/1959 | Ehrensperger | 239/354 |
| 3,622,078 | A | * | 11/1971 | Gronert | 239/337 |
| 5,119,992 | A | * | 6/1992 | Grime | 239/364 |
| 5,236,128 | A | * | 8/1993 | Morita et al. | 239/407 |
| 5,695,125 | A | * | 12/1997 | Kumar | 239/364 |
| RE35,769 | E | * | 4/1998 | Grime et al. | 239/72 |
| 5,979,797 | A | * | 11/1999 | Castellano | 239/346 |

* cited by examiner

*Primary Examiner*—Michael Mar
*Assistant Examiner*—Thach H. Bui
(74) *Attorney, Agent, or Firm*—Martin Fleit; Paul D. Bianco; Fleit Kain Gibbons Gutman Bongini & Bianco P.L.

(57) ABSTRACT

Disclosed is a spray pistol having a pistol body, a nozzle system which is arranged on the pistol body, a compressed air supply channel which is arranged in the pistol body and with a valve device for control of the compressed air supply to the nozzle device, a regulating device for regulating the supply of the substance to be sprayed, an actuating element for actuating the valve system and the regulating device, a device for regulating the supply of compressed air to the nozzle device, a pressure measuring device for detecting and indicating the pressure in the compressed air supply channel, wherein the pressure-measuring device is integrated into the device used to regulate the compressed air supply.

9 Claims, 2 Drawing Sheets

SPRAY PISTOL

BACKGROUND OF THE INVENTION

1. Field of the Invention

The invention pertains to a paint spray pistol.

2. Discussion of the Related Art

When working with a spray pistol it is desirable to adjust the spray pressure so that an optimum atomizing is achieved to ensure an optimum painting result at a good working speed and at a high application efficiency. If the spray pressure is too low, for examples changes in color tone in the base lacquer, or an increase in the orange hue in a clear lacquer and unilacquer, or a reduction in the working speed and possibly the formation of streaks may occur. On the other hand, if the spray pressure is too great, the result may be large mists of the sprayed material and thus greater losses and undesirable pollution of the working environment. During the spray process as well, the available pressure should be monitored in order to detect, for example, any potential pressure drop through additional power consumers in the compressed air supply network, or a pressure increase through connection of resources.

For adjusting and monitoring of the peak pressure, a pressure control valve with pressure gauge is often inlet-connected to the spray pistol. The pressure is adjustable by means of an adjusting knob on the pressure control valve and can be read off at the pressure gauge. However, this pressure control valve located at the air inlet to the paint spray pistol results in lengthening of the spray pistol, so that its handling features are not as good. In addition, the pressure gauge or the pressure control valve causes a pressure drop due to internal bypasses. In addition, as a rule the screwed on pressure control valve has to be dismantled in washing devices or cleaning tubs for cleaning of the spray pistol, since the indicating accuracy of the pressure gauge can be adversely affected by any penetrated solvent or lacquer or paint residues. The pressure control valve with the pressure gauge must therefore be unscrewed for each cleaning process, which is associated with considerable labor expense.

Paint spray pistols are already known that have a connection on the underside of the handle for connecting a conventional pressure gauge. The pressure gauges normally used have a semi-circular or helical-curved steel tube spring as pressure sensor, as a rule, whose pressure-based change in shape is displayed by a pointer on a corresponding dial. The steel tube spring and the display device are located in a separate housing. But with this design as well, the handling of the spray pistol is adversely affected by the connected pressure gauge. In addition, the pressure gauges have to be detachable for cleaning, so that relatively complicated coupling or connecting systems are needed for connection of the pressure gauge to the spray pistols.

It has already been proposed to attach a conventional pressure gauge to one side of the pistol body. These spray pistols as well have poor handling properties due to the pressure gauge protruding to the side. In addition, a spray pistol of this kind has to be handled with exceptional care so that the lateral protruding pressure gauge will not be damaged when the spray pistol is set down.

The purpose of the invention is to create a compact and handy spray pistol with a pressure measuring device which is simple to monitor during the spray process.

DETAILED DESCRIPTION OF PREFERRED EMBODIMENTS

In the spray pistol according to this invention, a pressure measuring device is integrated into the device for regulation of a compressed air supply. Thus, a precision setting of the compressed air supply and a pressure measurement with corresponding display can be combined in a very compact and space-saving manner.

For example, a particularly useful design is characterized in that a display device designed as an analog or digital display is arranged on an adjusting element of the pressure control device, so that it can be read off from behind. The advantage is that the pressure display during spraying will always be within the operator field of vision.

In one embodiment, the pressure sensor is in connection with the compressed air supply channel via only one capillary and is otherwise hermetically sealed to the outside together with the other components of the pressure measuring device. Because of this capillary, the solvent, lacquer or paint residues used for cleaning of the spray pistol can be kept from penetrating into the region of the pressure sensor and there affecting or preventing an orderly measurement of the pressure. The paint spray pistol according to this invention can thus be cleaned without disassembly of the measuring device, and there is no danger to the generally sensitive pressure sensor.

Figure 1:
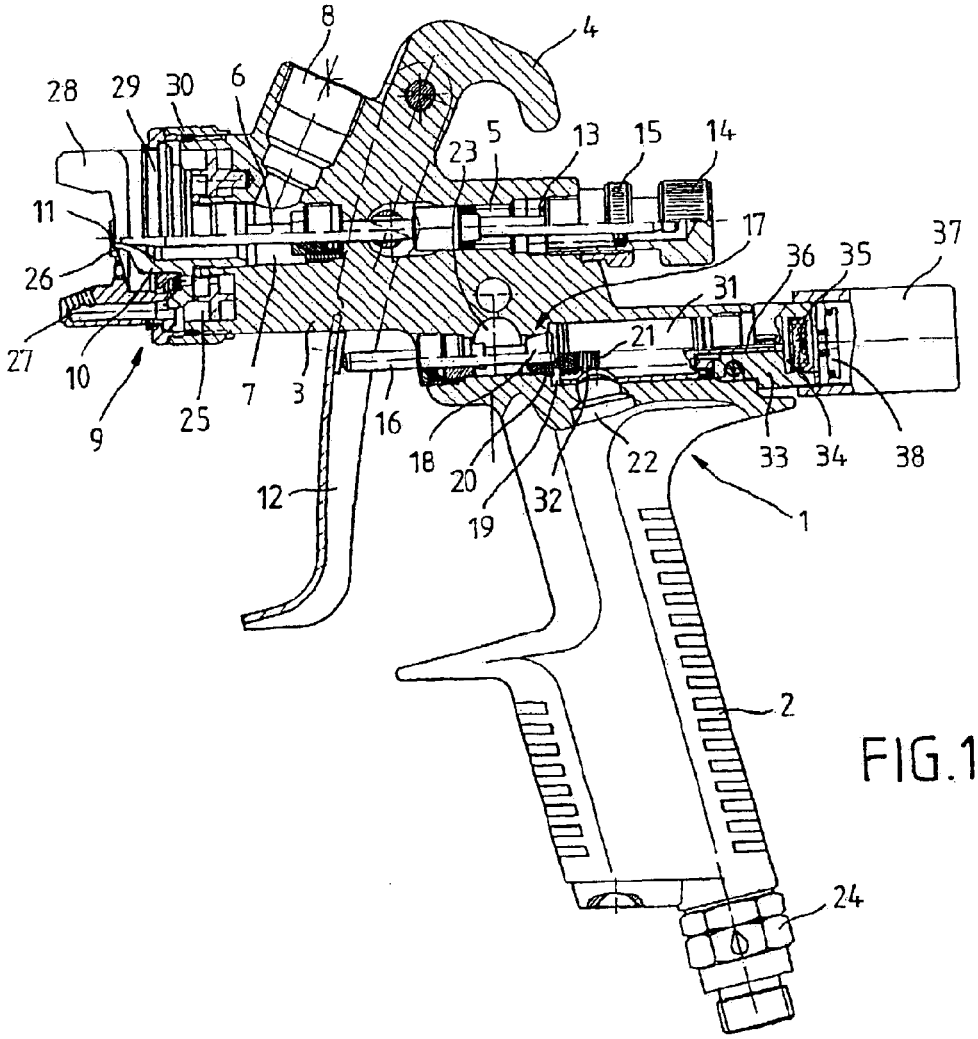
FIG. 1, partial cut-away side view of a spray pistol according to this invention.
Figure 2:
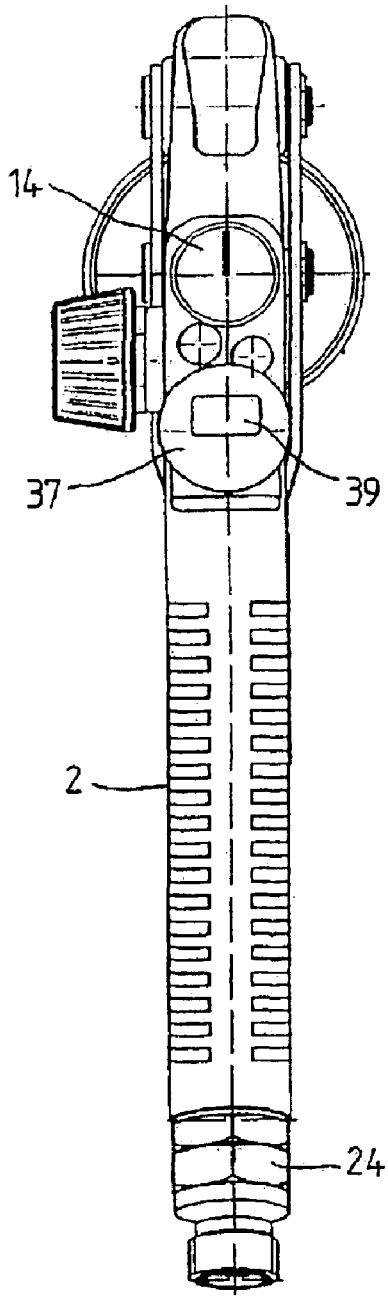
FIG. 2 is a rear view of the spray pistol of FIG. 1.

Referring to FIGS. 1 and 2, the spray pistol comprises a pistol body 1 with a handle 2 and an upper part 3, to which a hook 4 is molded for hanging up the pistol. A transit hole 5 runs from front to back, in several stages through the upper part 3 and a nozzle needle 6 can slide axially therein. The transit hole 5 in one front region forms an expanded reception compartment 7 in which a slanting inlet hole 8 is provided for setting on a paint container (not illustrated). On the front end of the transit hole 5 there is a nozzle device 9 that contains a paint nozzle 10 that can be locked by means of threading at the upper part 3 of the pistol body 1. On its front end the paint nozzle 10 has a nozzle hole 11 that, together with a pointed end part of the nozzle needle 6 that is axially movable via an actuating lever 12, forms a controllable inlet for the paint, lacquer, or the like. The actuating lever 12 is connected with the nozzle needle 6 in such a manner that when the actuating lever 12 is pulled back against the force of a spring 13, this needle is pushed backward and opens the nozzle hole 11 for dispensing of the paint. The tension of the compression spring 13 can be adjusted by means of a setscrew 14 (with associated lock nut 15) located at the rear end of the transit hole 5. A valve device 17 to control the compressed air supply to the nozzle device 9 can also be operated by the actuating lever 12 by means of a rod 16.

The valve device 17 contains a closing wedge 18 connected with the rod 16 and a valve seat 20 located in a hole 19 in the pistol body 1, against which the closing wedge 18 is pressed by a spring 21. When pulling back the actuating lever 12, the closing wedge 18 is lifted against the force of the spring 21 via the rod 16 from the valve seat 20, and a connection is opened between a lower part 22 located upstream of the valve device 17, and an upper part 23 located downstream of the valve device 17, of a compressed air supply channel for the compressed air supply to the nozzle device 9. At the underside of the handle 2 there is a compressed air connection 24 for a compressed air line connected to the lower part 22 of the compressed air supply channel.

The compressed air is directed from the upper part 23 of the compressed air supply channel to an air control system 25, and from there to an annular gap 26 which surrounds the nozzle hole 11. The compressed air generates a vacuum in the region of the nozzle hole 11 so that the paint is suctioned from the nozzle hole 11 and is carried along with the compressed air to form a round jet. By means of so-called horn-shaped air holes 27 in the protruding horns 28 of an air cap 29 surrounding the paint nozzle 10, the compressed air can also exit in a flat jet to form the round jet. The air cap 29 can be attached to the upper part 3 of the housing 1 by means of a cap screw 30.

In addition, a device to regulate the supply of compressed air is located in the drilled hole 19 in the pistol body 1. This device contains a rotary casing 31 which has a transverse hole 32 in the region of the opening of the lower part 22 of the compressed air supply channel into the hole 19. The casing 31 is joined to and rotates with a rear receiving part 33 which is located at the rear end of the drilled hole 19. By turning the receiving part 33, the casing 31 can thus also be turned and accordingly the air throughput in the region of the transverse hole 32 will be regulated.

A recess with a pressure measuring chamber 34 is located within the receiving part 33 for a pressure transducer 35 (such as a piezolelectric transducer, for example) of a pressure measuring device to determine and display the available pressure. The pressure acquisition chamber 34 is connected with the compressed air supply channel via a capillary 36 running in the axial direction of the receiving part 33. By means of the capillary 36, the pressure can be determined in the part 22 of the compressed air supply channel located upstream of the valve device, without being affected by check valves or such. In addition, due to the capillary 36, the cleaning fluid or solvent, and any dissolved paint or lacquer particles used in cleaning of the spray pistol, can be prevented from moving along the compressed air supply channel into the pressure measurement chamber 34 and interfering there with the measuring accuracy and even preventing the measurement altogether. This capillary 36 has preferably a diameter of between 0.5 and 1.8 mm.

In addition, a housing 37 is attached to the receiving part 35. This housing holds a switching device 38 for conversion and/or evaluation of the signals from the pressure sensor 35, a battery (not illustrated) to supply electric power and a digital display device 39 illustrated in FIG. 2. The connection between the receiving part 35 and the housing 37 is fully self-contained, so that no cleaning fluid or such can get onto the sensitive components of the pressure measuring device. The housing 37 is designed preferably as a rotary knob. Thus, the device for regulation of the compressed air supply and the pressure measuring device can be combined in a very compact and space-saving manner.

The invention is not limited to the embodiments described above and illustrated in the figures. For example, instead of a piezoelectric pressure transducer, other suitable pressure transducers ore pressure sensors can be used. In addition, the pressure sensors can also be located at different sites.

What is claimed is:

1. A spray pistol, comprising:

a pistol body;

a nozzle system arranged on the pistol body;

a compressed air supply channel arranged in the pistol body leading to the nozzle system, with a valve for control of the compressed air supply to the noble system;

a supply regulating device for regulating the supply of a substance to be sprayed;

an actuating element for actuating the valve and the supply regulating device;

a compressed air regulating device for regulating the supply of compressed air to the nose system, a pressure measuring device for detecting and indicating the pressure in the compressed air supply channel;

wherein the pressure measuring device is integrated into the compressed air regulating device; and wherein the compressed air regulating device contains a casing adjustable by means of a regulating element with a transverse drilled hole for adjusting of a transit cross section of the compressed air supply channel.

2. The spray pistol according to claim 1, wherein the pressure measuring device contains a pressure sensor arranged in the compressed air regulating device.

3. The spray pistol according to claim 1, wherein the pressure measuring device contains an indicating device arranged in the compressed air regulating device.

4. The spray pistol according to claim 2, wherein the compressed air regulating device has a receiving part that rotates with the casing and has a housing joined to said receiving part.

5. The spray pistol according to claim 4, wherein the pressure sensor is located in the receiving part and the indicating device is located in the housing.

6. The spray pistol according to claim 5, wherein the indicator device is arranged at one back side of the housing.

7. The spray pistol according to claim 2, wherein the pressure sensor is in connection with the compressed air supply channel by means of a capillary.

8. The spray pistol according to claim 1, wherein the compressed air regulating device is designed as an adjusting knob.

9. The spray pistol according to claim 3, wherein the indicator device is designed as a digital display.

* * * * *